US008186804B2

(12) United States Patent
Muraoka

(10) Patent No.: US 8,186,804 B2
(45) Date of Patent: May 29, 2012

(54) INK JET RECORDING APPARATUS CONFIGURED TO CLEAN A BLADE

(75) Inventor: Chiaki Muraoka, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 726 days.

(21) Appl. No.: 12/328,943

(22) Filed: Dec. 5, 2008

(65) Prior Publication Data

US 2009/0147045 A1 Jun. 11, 2009

(30) Foreign Application Priority Data

Dec. 6, 2007 (JP) ..... 2007-315819

(51) Int. Cl.
*B41J 2/165* (2006.01)

(52) U.S. Cl. ..... 347/33; 347/36

(58) Field of Classification Search ..... 347/33
See application file for complete search history.

(56) References Cited

U.S. PATENT DOCUMENTS 5,614,930 A * 3/1997 Osborne et al. ..... 347/33
5,905,514 A * 5/1999 Rhoads et al. ..... 347/33
2007/0252868 A1* 11/2007 Sanada et al. ..... 347/33

FOREIGN PATENT DOCUMENTS

JP 7-68791 3/1995

* cited by examiner

*Primary Examiner* — Shelby Fidler
(74) *Attorney, Agent, or Firm* — Fitzpatrick, Cella, Harper & Scinto

(57) ABSTRACT

An ink jet recording apparatus includes a recording head having an ink ejection surface; a blade for wiping the ink ejection surface; a blade cleaning device that cleans the blade by collecting contamination liquid deposited on the blade and including at least ink; a cleaning liquid supplying device that supplies, to the blade, cleaning liquid mainly comprising liquid having a volatility lower than the ink; a residual ink absorbing material provided at such a position that it is out of contact to the blade; and a discharge path for discharging the contamination ink collected by the blade cleaning device to the residual ink absorbing material.

13 Claims, 8 Drawing Sheets

WAITING FOR CLEANING

WIPING

BLADE CLEANING

APPLYING CLEANING LIQUID

SWINGING

RESETTING

INK JET RECORDING APPARATUS CONFIGURED TO CLEAN A BLADE

FIELD OF THE INVENTION AND RELATED ART

The present invention relates to an ink jet recording apparatus which records on a recording medium by ejecting ink. In particular, it relates to an ink jet recording apparatus having a means for wiping the ink ejecting surface of its recording head.

An ink jet recording apparatus forms letters, pictures, and the like images, on recording medium, by adhering to the recording medium, the ink which it ejects through the nozzles of its recording head. It is a recording apparatus of the non-impact type, being therefore low in noise, and also, is capable of recording at a high speed as well as high level of density. On the other hand, however, it suffers from its own problems, because it ejects ink through minute nozzles. That is, while an ink jet recording apparatus is used, the ink which does not contribute to recording sometimes adheres to the ink ejecting surface of its recording head. The adhesion of ink to the ink ejecting surface interferes with the ejection of ink from the recording head. For example, it causes the recording head to eject ink in the wrong direction, or prevents the recording head from ejecting ink. Therefore, an ink jet recording apparatus is provided with a means for wiping clean (which hereafter may be referred to simply as "wiping") the ink ejecting surface of its recording head, in order to remove the ink having adhered to the ink ejecting surface. As a wiping means, such as the one described above, a blade capable of gliding on the ink ejecting surface while remaining in contact with the ink ejecting surface is used. More specifically, the ink having adhered to the ink ejecting surface of the recording head is removed by wiping the surface with the blade. Further, it is desired that an ink jet recording apparatus is provided with a means for cleaning the cleaning blade, in order to maintain the wiping performance of the blade. The blade cleaning means is to remove the liquid (which hereafter will be referred to as contaminated ink), which includes at least the ink having adhered to the blade while the blade was wiping the ink ejecting surface.

An example of an ink jet recording apparatus provided with a blade cleaning means is recorded in No. 3428893 of the official gazette of Patent Office of Japan. In the case of this ink jet recording apparatus, the contaminated ink having adhered to the blade is wiped away by placing the ink in contact with the edge portion of the blade cleaning member of the blade cleaning means. This cleaning method, however, is problematic in that as a blade cleaning means, such as the above described one, is repeatedly used, the contaminated ink accumulates on the blade cleaning means. If the ink ejecting surface is wiped with the cleaning blade on which the contaminated ink has accumulated by a substantial amount, the contaminated ink on the cleaning blade transfers back onto the ink ejecting surface, recontaminating the ink ejecting surface of the recording head.

Further, in recent years, the development of inks which are superior in recording density, water resistance and weather resistance, has been in limelight. However, inks which are superior in durability (fastness) are generally highly agglutinative, being therefore likely to more quickly increase in viscosity, and/or more quickly solidify after it adheres to the ink ejecting surface of the recording head of an ink jet recording apparatus, than an ordinary ink. Thus, the length of time it takes for an ink jet recording head to begin improperly ejecting ink after contaminated ink, which is higher in durability (fastness), is transferred back onto the ink ejecting surface of the recording head is substantially shorter than the length of time it takes for the ink jet recording head to begin improperly ejecting ink after contaminated ink, which is lower in durability (fastness), is transferred back onto the ink ejecting surface of the recording head.

Proposed in Japanese Laid-open Patent Application H07-068791 is a blade cleaning means, which is provided with a porous member for absorbing the contaminated ink to prevent the contaminated ink from transferring back onto the ink ejecting surface. According to this proposal, the contaminated ink on the blade is recovered by using a capillary tube, and then, is absorbed from the capillary tube by a porous member placed in contact with the opposite end the capillary tube from the end through the contaminated ink is recovered.

In the case of the structure of the blade cleaning means recorded in Japanese Laid-open Patent Application H07-068791, as an ink (pigment-based ink, for example) which is higher in durability (fastness) is used, the contaminated ink increases in viscosity in the porous member and/or capillary tube of a blade cleaning means, and/or solidifies in the porous member and/or capillary tube. That is, the when an ink which is high in durability (fastness) is used, the porous member and/or capillary tube, with which the blade cleaning means is provided, are likely to be plugged up, and therefore, the porous member is likely to deteriorate in the ability for absorbing the contaminated ink, earlier than expected. As one of the methods for solving this problem, it is possible to impregnate the porous member with liquid capable of dissolving the contaminated ink. However, the employment of this type of method subjects the joint between the capillary tube and porous member to the load generated by the weight of the contaminated ink in the porous member. This load interferes with the flow of the contaminated ink from the capillary tube into the porous member, making it difficult to increase the amount by which the contaminated ink can be absorbed by the porous member. Therefore, it is difficult to continuously and satisfactorily wipe clean the ink ejecting surface of a recording head for a long time.

SUMMARY OF THE INVENTION

The primary object of the present invention, which was made in consideration of the above described problems of the prior art, is to provide an ink jet recording apparatus, the amount by which it can store the contaminated ink recovered by its blade cleaning means is significantly greater than the amount by which an ink jet recording apparatus in accordance with the prior art can stores the contaminated ink recovered by its blade cleaning means.

Another object of the present invention is to provide an ink jet recording apparatus, which is capable of continuously and satisfactorily wiping clean the ink ejecting surface of its recording head for a long period of time, and therefore, is capable of continuously and satisfactorily ejecting ink for a long period of time, and yet, is simple in structure. Another object of the present invention is to provide an ink jet recording apparatus, the ink ejecting performance of which remains the same whether it is used with an ink which is high in durability (fastness), or an ink which is normal in durability (fastness).

According to an aspect of the present invention, there is provided an ink jet recording apparatus comprising a recording head having an ink ejection surface; a blade for wiping said ink ejection surface; blade cleaning means for cleaning said blade by collecting contamination liquid deposited on said blade and including at least ink; cleaning liquid supplying means for supplying, to said blade, cleaning liquid mainly comprising liquid having a volatility lower than the ink. A residual ink absorbing material provided at such a position that it is out of contact to said blade; and a discharge path for discharging the contamination ink collected by said blade cleaning means to said residual ink absorbing material.

According to the present invention, it is possible to provide an ink jet recording apparatus, which is capable of maintaining the ink ejecting performance of its recording head at a satisfactorily level for a long period of time, by being capable of continuously and satisfactorily wiping clean the ink ejecting surface of its recording head for a long period of time.

These and other objects, features, and advantages of the present invention will become more apparent upon consideration of the following description of the preferred embodiments of the present invention, taken in conjunction with the accompanying drawings.

DETAILED DESCRIPTION OF PREFERRED EMBODIMENTS

Hereinafter, the preferred embodiments of the present invention will be described with reference to the appended drawings.

Figure 1:
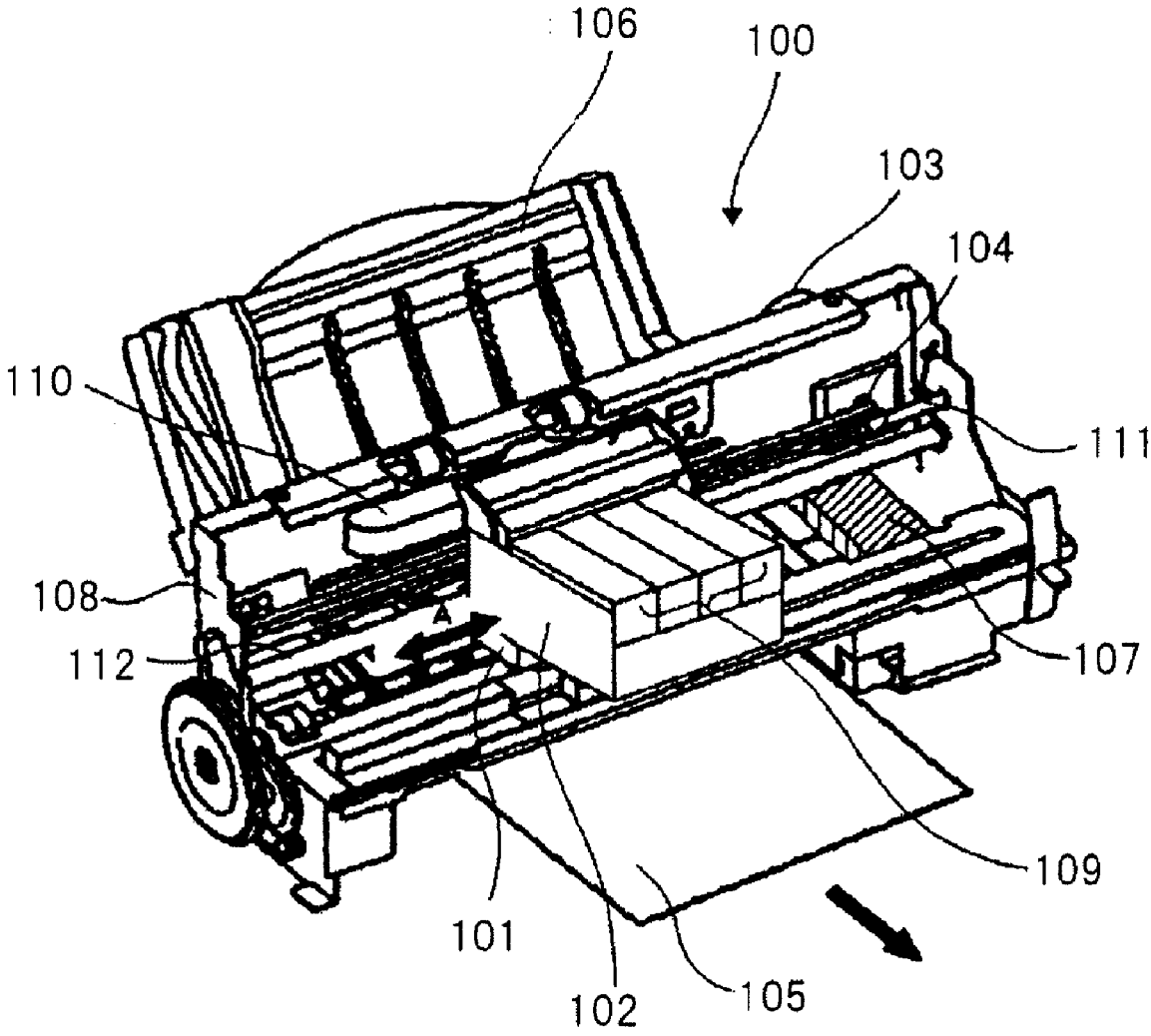
FIG. 1 is a perspective view of the ink jet recording apparatus in the first of the preferred embodiments of the present invention.

FIG. 1 is a perspective view of the ink jet recording apparatus in the first preferred embodiment of the present invention. An ink jet recording apparatus 100 has a recording head 101 for ejecting ink, and a carriage 102 on which the recording head 101 is mounted.

The carriage 102 is shaped so that an ink container 102 for supplying the recording head 101 with recording ink can be mounted on the carriage 102. It is structured so that the ink container 109 is removably mountable thereon, and also, the ink container 102 thereon can be replaced with another ink container 102.

Further, one end of the carriage 102 is supported by a carriage guide 112, which extends in the direction indicated by a double-headed arrow mark in FIG. 1. Further, the ink jet recording apparatus 100 is provided with a combination of a motor 103 and a driving force transmitting mechanism 104, which is for moving the carriage 102 back and forth along the carriage guide 112.

Further, the ink jet recording apparatus 100 is provided with a paper feeding mechanism 106, which is positioned so that as ink is ejecting out of the recording head 101, it lands on a recording medium 105 in a manner to form an image on the recording medium 105.

Further, the ink jet recording apparatus 100 is provided with a maintenance unit 107 for maintaining the recording head 101 in terms of recording performance, and also, for restoring the recording head 101 in terms of recording performance. The maintenance unit 107 is located outside the path of the recording medium 105. The structural components of the ink jet recording apparatus 100 described above are attached to the chassis 108 of the ink jet recording apparatus 100.

In order to control the carriage 102 in terms of its position in its moving range, the ink jet recording apparatus 100 is provided with a code strip 111, which is parallel to the carriage guide 112. Further, the carriage 102 is provided with a linear encoder (unshown), which is capable of reading the black bars printed on the code strip 110 with preset intervals. Thus, the ink jet recording apparatus 100 can precisely determine the location of the carriage 101. Further, the ink jet recording apparatus 100 is provided with a referential position for the carriage 102, which is within the moving (shuttling) range of the carriage 102, and which is used to initialize the ink jet recording apparatus 100 in terms of the position (absolute position) of the recording head 101. As for the methods for initializing the ink jet recording apparatus 100 in terms of the recording head position, there are the method which causes the carriage 101 to come into contact with a specific member, method which provides a special portion of the code strip 111 with a printed pattern dedicated to the initialization, etc.

Figure 2:
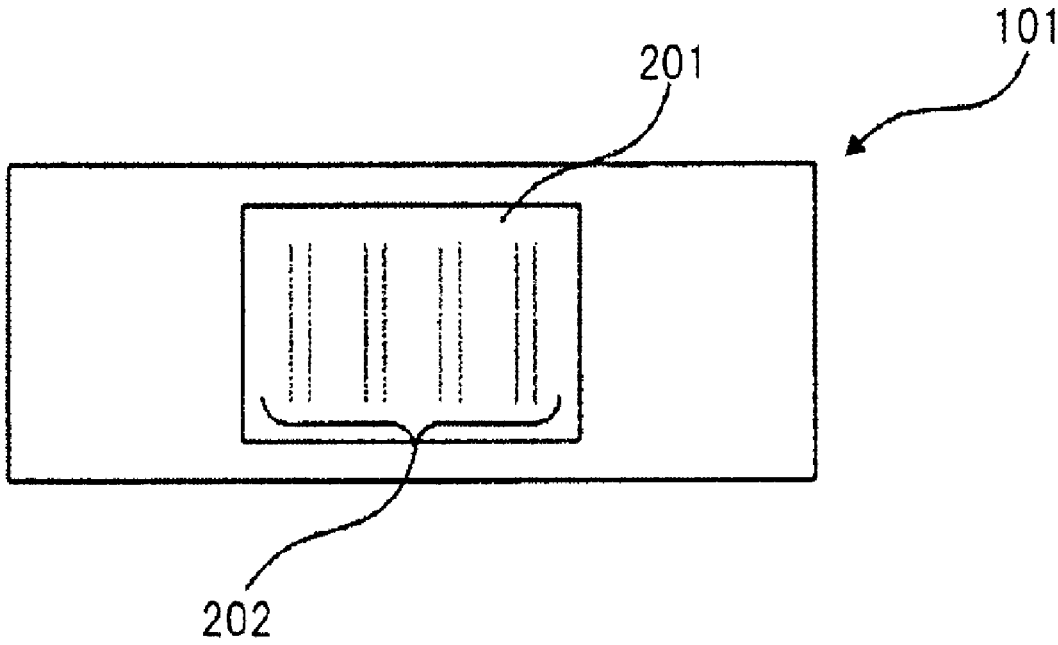
FIG. 2 is a plan view of the ink ejecting surface of the recording head shown in FIG. 1.

FIG. 2 is a drawing for describing the structure of the ink ejecting surface 201 of the recording head 101. The ink ejecting surface 201 has the opening of each of the multiple ink ejecting nozzles 202. Each ink ejecting nozzle 202 (which hereafter will be referred to simply as ink nozzle 202) is provided with a means for generating the energy for ejecting ink. As the means for generating the ink ejecting energy, a heater or a piezoelectric element is used. In a case where a heater is used as the means for generating the ink ejecting energy, the heater is driven to very quickly heat the ink in the nozzle, in order to boil the ink in the so-called film-boiling fashion. As the ink boils in the film-boiling fashion, the force from the expansion of a bubble generated by the boiling of the ink is used to cause the ink in the nozzle to eject out of the nozzle. In a case where a piezoelectric element is used as the means for ejecting ink, each of the ink passages, or a part of the ink storage chamber, is provided with a piezoelectric element. If it is required to cause a given nozzle to eject out the ink therein, the piezoelectric element in the nozzle is made to deform by a preset electrical signal. In other words, the ink in the nozzle is pushed out (ejected out) by driving the piezoelectric element in the nozzle.

As the means for driving the means for generating the ink ejecting energy, an electrical signal is used. The electrical signal is supplied to the carriage 102 from the control chip (unshown), which the ink jet recording apparatus 100 has, through a flexible cable 110. As the electrical signal is supplied to the carriage 102, it is transmitted to the recording head 101, and drives the ink ejecting energy generating means, causing thereby the ink in the nozzle to eject out of the nozzle.

Each electrical signal is transmitted with a preset timing to cause a specific nozzle to eject the ink in the nozzle onto the recording medium 105 supplied from the recording medium (paper) feeding mechanism 106, while the recording medium 101 is conveyed at a preset pitch in synchronism with the movement of the carriage 102. As a result, ink is deposited on the desired points across the entirety of the recording medium 105.

In order to ensure that the ink is accurately ejected from the recording head 101, the recording head 101 has to be properly maintained. The maintenance of the recording head 101 is carried out by a maintenance unit 107, which wipes the ink ejecting surface 201 of the recording head 101 to remove the unwanted matters on the ink ejecting surface 201, and also, causes the nozzle to discharge the ink therein to remove the bubbles remaining in the nozzle, and also, to remove the impurities having entered the nozzle.

Next, the structure of the maintenance unit 107 will be described in detailed with reference to FIG. 3. The maintenance unit 107 has a capping means 308, a pair of blades 301, a blade cleaning means 303, a cleaning liquid supplying means 305, and a waste ink absorbing means 310.

Each blade 301, that is, a wiper, is flat, and in the form of a long and narrow rectangle. It is fastened to a blade holder 302 by its bottom edge. The blade holder 302 is attached to a pair of blade holder guides 306, which are straight and parallel to the direction of the normal line of the surface of the blade 301. The blade holder 302 is reciprocally movable along the blade holder guides 306. That is, the blade 301 is reciprocally movable in the direction parallel to the normal line of the surface of the blade 301. As will be evident from FIG. 3, the maintenance unit 107 is provided two blades 303, which are fixed to the blade holder 302.

When the blades 301 are not used for wiping the surface 201 of the recording head 101, they are kept on standby in their standby positions 313, which are at one end of the moving range of the blades 301. As for the order, in terms of closeness to the standby position 313, in which the abovementioned components of the maintenance unit 107 are position, the cleaning position 312, blade cleaning means 303, and cleaning liquid supplying means 303 are positioned in the listed order within the moving range of the blades 301. The cleaning position 312 is the position in which the blades 301 are when they wipe the ink ejecting surface 201 of the recording head 101.

As the maintenance operation for the recording head 101 is started, the recording head 101 is moved, along with the carriage 102, to the cleaning position 312, at which the maintenance unit 107 carries out its cleaning operation. FIG. 3 shows the recording head 101 and carriage 102, which are at the cleaning position 312. The maintenance unit 107 is positioned so that as the blades 301 are moved, the ink ejecting surface 201 of the recording head 101 (which is in the cleaning position 312) comes into contact with the top edge portion of each blade 301. Further, the blade cleaning means 303 and cleaning liquid supplying means 305 are positioned so that as the blade 301 are moved, the top edge portion of each blade 301 comes into contact with the blade cleaning means 303 and cleaning liquid supplying means 305.

Further, the waste ink absorbing member 310 is positioned lower than the blade cleaning means 303. In this embodiment, the waste ink absorbing member 310 is positioned directly below the blade cleaning means 303. Further, the blade cleaning means 303 is in connection to a pair of conduits 304 which are tubular members for guiding the recovered contaminated ink to the waste ink absorbing member 310.

The blade 301 is used to wipe away the ink, paper dust, and the like, which have adhered to the ink ejecting surface of the recording head 101. The blade 301 is placed in contact with the ink ejecting surface 210 of the recording head 101 by the movement of the blade holder 302, and then, is made to wipe the ink ejecting surface 201 of the recording head 101 by the further movement of the blade holder 302.

The blade cleaning means 303, which is a cleaner, removes the contaminated ink having adhered to the blade 301, and then, collects (recovers) the contaminated ink as it removes the ink. "Contaminate ink" means the ink having adhered to the blade 301, or the mixture of the ink having adhered to the blade 301 and the cleaning liquid (which will be described later).

Figure 4:
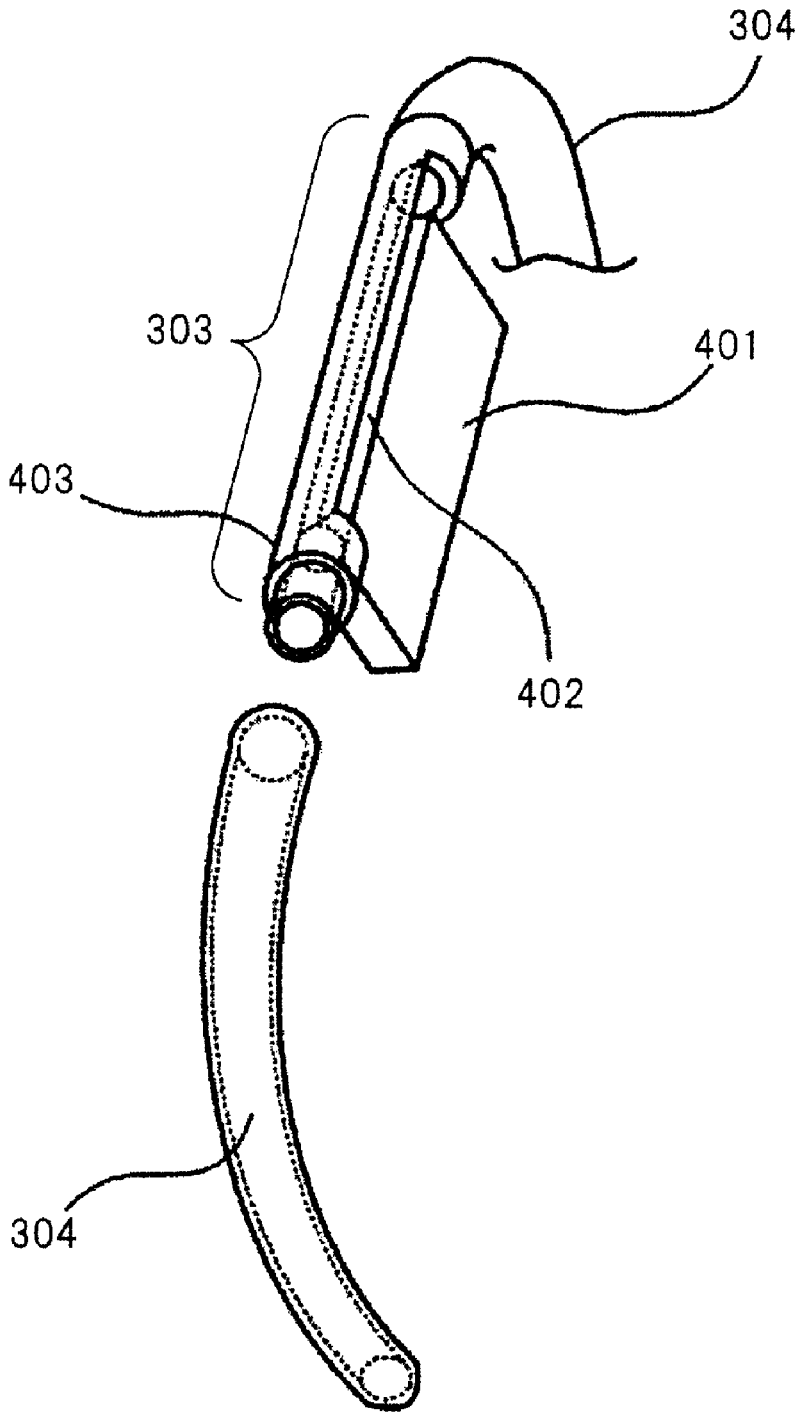
FIG. 4 is a perspective view of the blade cleaning means shown in FIG. 1.

Next, referring to FIG. 4, the structure of the blade cleaning means 303 will be described in detail. The broken lines in the drawing are for providing the phantom view of the interior of the blade cleaning means 303. The blade cleaning means 303 is made up of an edge portion 401, a contaminated ink recovering portion 402, and a pair of joint portions 403. The edge portion 401 is wide enough to contact the entirety of the cleaning edge portion of the blade 301 in terms of the lengthwise direction of the blade 301. The contaminated ink recovering portion 402 (which hereafter will be referred to simply as recovery portion 402) is shaped like a cylindrical hollow column, the lateral wall of which is partially missing. It has grooves which are small enough to generate capillary force. It is attached to the edge portion 401, and recovers the contaminated ink by its capillarity as the contaminated ink is scraped away from the blade 301. The joint portions 403 are structured so that the contaminated ink recovered by the recovery portion 402 can pass through the joint portions 403. Further, each joint portion 403 is provided with a protruding portion, which can be pressed into the ink guiding tube 304 to connect the joint portion 403 and ink guiding tube 304 to each other; the outward end of the joint portion 403 is connected to the ink guiding tube 304, which is a contaminated ink guiding member. As described above, the recovery portion 402 of the blade cleaning means 303 is connected to the pair of conduits 304, or recovered ink guiding tubes, so that the recovered contaminated ink flows through the joint portions 403 between the recovery portion and the recovered ink guiding tubes 304.

As each of the abovementioned blades 301 moves, the blade 301 passes by the blade cleaning means 303, with the top edge portion of the blade 301 remaining in contact with the edge portion 401. Thus, the edge portion 401 scrapes the contaminated ink having adhered to the blades 301, away from the blades 301. Further, the contact pressure between each blade 301 and edge portion 401 can be increased by using an elastic substance, for example, rubber, as the material for the edge portion 401. Increasing the contact pressure can increase the efficiency with which the contaminated ink having adhered to the blade 301 is scraped away from the blade 301.

The grooves of the recovery portion 402 are structured so that they are greater in capillarity than the edge portion 401. Therefore, it is possible for the contaminated ink to be recovered after being scraped away from the blades 301 by the edge portion 401.

Figure 5:
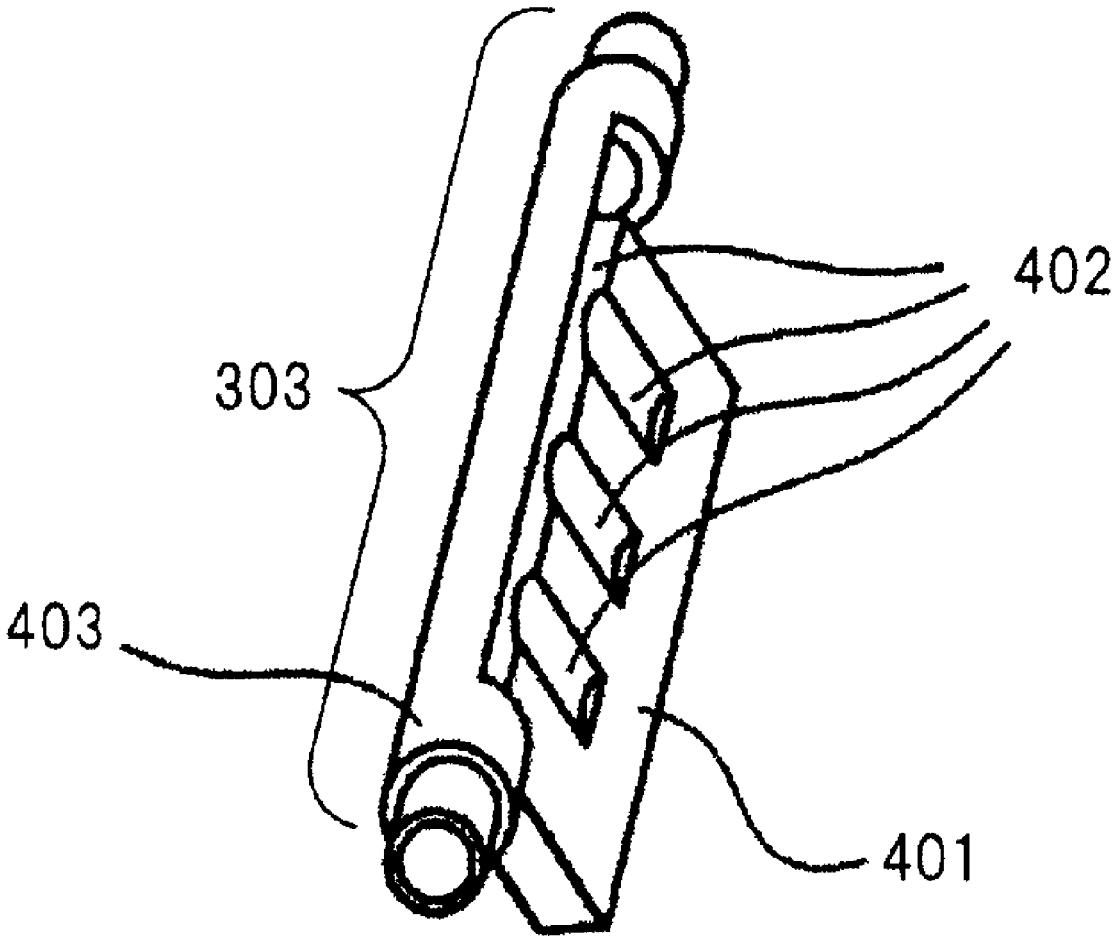
FIG. 5 is a perspective view of the blade cleaning means in another preferred embodiment of the present invention.

Referring to FIG. 5, the recovery portion 402 may be made up of multiple grooves. Providing the recovery portion 402 with multiple grooves makes it possible to more efficiently recover the contaminated ink after the contaminated ink is scraped away from the blades 301.

Further, each joint portion 403 is structured to generate a greater amount of capillary force than the recovery portion 402 so that the contaminated ink is efficiently conveyed to the joint portions 403 after the contaminated ink is recovered by the recovery portion 402. After the recovered contaminated ink is conveyed to the joint portions 403, it flows through the ink guiding tube 304, and then, is guided onto the waste ink absorbing member 310, preventing thereby the problem that the contaminated ink collects on the blade cleaning means 304. Therefore, the contaminated ink does not transferred back onto the blade 301 from the blade cleaning means 303.

The recovery portion 402, joint portions 403, and guiding tubes 304 make up the ink removing means for removing the contaminated ink from the edge portion 401.

Figure 3:
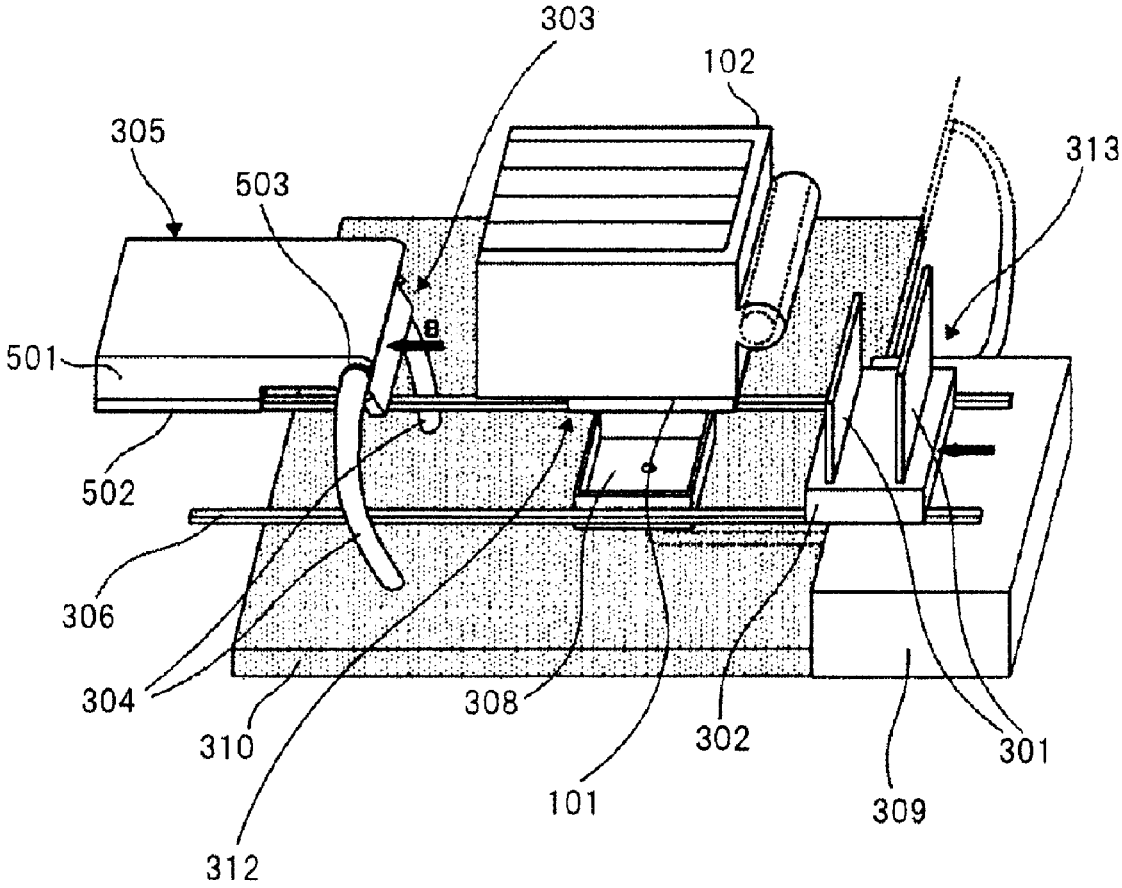
FIG. 3 is a perspective view of the maintenance unit shown in FIG. 1.

Further, the cleaning liquid supplying means 305 shown in FIG. 3 is provided with a supporting portion 503 for supporting the blade cleaning means 303. The supporting portion 503 is at the end of the cleaning liquid supplying means 305, on the side from which the blades 301 come into contact with the blade cleaning means 303. It is in the supporting portion 503 that the joint portions 403 of the blade cleaning means 303 are fitted so that they are allowed to rotate by a preset angle while remaining fitted.

The blades 301 come into contact with the edge portion 401 of the blade cleaning means 303, by being moved in the direction indicated by an arrow mark B in FIG. 3. Whether the blades 301 come into contact with the edge portion 401 or not, the edge portion 401 remains stationary, remaining in its preset position (which hereafter will be referred to as home position. Thus, while each blade 301 is in contact with the edge portion 401 when the edge portion 401 is in its home position, there is a substantial amount of contact pressure between them, and therefore, the edge portion 401 can effectively scrape the contaminated ink having adhered to the blades 301, away from the blades 301. On the other, as the blades 301 are moved in the opposite direction (in which blades 301 are moved to be returned to standby position 313) from the direction indicated by the arrow mark B, the blade cleaning means 303 rotates as if the joint portions 403 were their rotational axle; in other words, the blade cleaning means 303 rotates away (retreats) from its home position. As the blade cleaning means 303 retreats from its home position, the contact pressure between each blade 301 and blade cleaning means 303 becomes smaller. Thus, the contact pressure generated between each blade 301 and blade cleaning means 303 when the blade 301 is moved toward its standby position 313 is smaller than that when the blade 301 is moved for its cleaning. As soon as each blade 301 is moved past the blade cleaning means 303 toward its standby position 313, the blade cleaning means 303, which had rotated away from its blade cleaning position, automatically rotates back into its blade cleaning posture. As for the mechanism which allows the blade cleaning means 303 to revert into its blade cleaning posture, the weight of the blade cleaning means 303 itself can be utilized, or a spring or the like member may be provided to apply to the blade cleaning means 303, such a force that is opposite in direction to the direction in which the blade cleaning means 303 is rotated by the blades 301 when the blades 301 are moved back into their standby positions.

As the blade cleaning means 303 is moved as described above, each of the ink guiding tubes 304 is rotationally moved as if it were a swing attached to the end of the supporting portion 503. That is, the blade 301 in motion, and the edge portion 401 which is being swayed by the blade 301, make up the means which causes the guiding tube 304 to sway. The swaying of the guiding tube 304 gives the contaminated ink in the guiding tube 304 centrifugal force which works in the direction to move the ink toward the exit side of the guiding tube 304. Further, since the waste ink absorbing member 310 is directly below the blade cleaning means 303, the contaminated ink in the ink guiding tube 304 is affected by the gravity which acts on the contaminated ink in the ink guiding tube 304, in the direction to move the contaminated ink toward the exit side of the guiding tube 304, contributing to the extraction of the contaminated ink from the ink guiding tube 304. Further, the blade cleaning means 303 is structured so that the exit end of the ink guiding tube 304 is in contact with the waste ink absorbing member 310, at least when the blade cleaning means 303 is on standby.

Further, the cleaning liquid supplying means 305, shown in FIG. 3, which is a liquid supplying means, has a cleaning liquid storing portion 501, which is in the cleaning liquid supplying means 305. The surface of the cleaning liquid supplying means 305, with which the blade 301 comes into contact, has a cleaning liquid outlet 502, which is made up of a porous substance with capillarity. Thus, the cleaning liquid in the cleaning liquid storage portion 501 forms meniscus in the cleaning liquid outlet 502, being thereby prevented from leaking through the cleaning liquid outlet 502. As the blade 301 comes into contact with the cleaning liquid outlet 502, the meniscuses having been formed in the cleaning liquid outlet 502 by the cleaning liquid are broken by the contact, allowing the cleaning liquid to flow out of the cleaning liquid storing portion 501 so that the blade 301 is coated with the cleaning liquid.

As long as the cleaning liquid outlet 502 can be supplied with the cleaning liquid, the storage portion 501 may be any storage portion. For example, it may be filled with a porous member, which is smaller in capillary force than the cleaning liquid outlet 501, or may be a plain empty space.

It is desired that the cleaning liquid is one of those which can easily dissolve or disperse the ink having adhered to the ink ejecting surface 201 of the recording head 101. Further, it is also desired that the primary ingredient of the cleaning liquid is a liquid which is lower in volatility than the ink. Employing one of such inks as those described above can improve the efficiency with which the ink ejecting surface 201 of the recording head 101 is wiped clean.

Further, the employment of a cleaning liquid which is low in volatility can prevents the contaminated ink from drying up after its adhesion to the blade 301. In other words, it can keep the contaminated ink fluid after the adhesion of the contaminated ink to the blade 301, making it thereby possible to draw the contaminated ink into the waste ink absorbing member 310 even when an ink which is higher in terms of durability (fastness) is used. As an example of cleaning liquid, such as the one described above, water solution of glycerin may be listed. Incidentally, when water solution of glycerin is used, the glycerin percentage is desired to be no less than 50%. Further, as the examples of ink which are high in durability (fastness), there are inks which contain pigment.

The waste ink absorbing member 310 is desired to be formed of a porous material capable of absorbing the contaminated ink. Further, the pores of the porous material for the waste ink absorbing member 310 are smaller in diameter than the internal diameter of the waste ink guiding tube 304, in order to ensure that the waste ink absorbing member 310 is greater in capillary force than the ink guiding tube 304, and therefore, the contaminated ink is efficiently drawing into the waste ink absorbing member 310 from the ink guiding tube 304.

Further, the waste ink absorbing member 310 is desired not be water repellent; it is desired to have a certain amount of affinity for water. With the waste ink absorbing member 310 having a certain level affinity for water, the adjacencies of the waste ink absorbing member 310 is kept humid by the contaminated ink having been drawn into the waste ink absorbing member 310. That is, the blade cleaning means 303, which is above the waste ink absorbing member 310, is kept in a humid environment. Therefore, the contaminated ink in the waste ink absorbing member 310 is better prevented from drying up. Therefore, the maintenance unit 107 in this embodiment is significantly greater in the level of fluidity with which the contaminated ink flows through the ink guiding tube 304 than a conventional maintenance unit, that is, a maintenance unit in accordance with the prior art. Therefore, the maintenance unit 107 in this embodiment can significantly more efficiently draw the contaminated ink into the waste ink absorbing member 310 than a conventional maintenance unit, even when an ink which is high in durability (fastness) is used.

Further, the waste ink absorbing member 310 is desired to be replaceable so that it can be ensured that the contaminated ink is efficiently absorbed away for a long period of time. Incidentally, it is desired that, if necessary, the waste ink absorbing member 310 is impregnated with a solvent capable of dissolving or dispersing the ink having increased in viscosity. With the waste ink absorbing member 310 impregnated with such a solvent, it is possible to prevent the waste ink absorbing member 310 from clogging up.

The capping means 308 is disposed below the recording head cleaning position 312 of the maintenance unit 107. It is structured so that it can cover the entirety of the ink ejecting surface 201. Further, the capping means 308 is in connection with the a suctioning means 309, and one end of the suctioning means 309 is in connection with the waste ink absorbing member 310.

In a case where a recording operation of the recording head 101 is suspended longer than a preset length of time, the ink ejecting surface 201 is placed in the "capped state". The "capped state" means the state in which the ink ejecting surface 201 remains airtightly sealed by being entirely covered by the capping means 308. Capping the ink ejecting surface 201 can ensure that the recording head 101 is prevented from being physically damaged, and also, the ink in each ink ejecting nozzle 202 of the recording head 101 is prevented from drying up. That is, the capping can prevent the ink ejecting nozzle 202 from clogging up. Further, while the ink ejecting surface 201 remains capped, the ink ejecting nozzle 202 may be forced to discharge the ink therein, by suctioning the ink ejecting nozzle 202 by the suctioning means 309, in order to make the ink ejecting nozzle 202 discharge the air bubbles, high viscosity ink (body of ink, from which its volatile ingredients have evaporated), debris, etc., along with the ink. Described above is how the recording head 101 is maintained in terms of ink ejecting performance. The body of waste ink (which hereafter will be referred to simply as waste ink) having been discharged by the suctioning means 309 as described above, is eventually discharged into the waste ink absorbing member 310. As described above, the waste ink absorbing member 310 can be utilized as a liquid storage portion for the waste ink. Integrating the member for storing the contaminated ink, and the member for storing the waste ink, into a single member as described above can simplify the maintenance unit 107 in structure. It is desired that this integration causes the contaminated ink and waste ink to mix with each other as little as possible, in order to ensure that the waste ink absorbing member 310 remains absorbent for a long time. This can be easily achieved by placing the discharging end of the ink guiding tube 304, away from the outlet of the suctioning means 309. Further, a part of the waste ink absorbing member 310 may be separated from the main portion of the waste ink absorbing member 310.

It is possible that when ink is forcefully discharged by the suctioning means 309 as described above, the discharge ink will adheres to the ink ejecting surface 201 of the recording head 101. Thus, it is desired that when this process of forcefully discharging ink is carried out, the above described process of wiping the ink ejecting surface 201 of the recording head 101 is also carried out so that the recording head 101 is better maintained.

Next, referring to FIGS. 6A-6F, the flow of the process of wiping the ink ejecting surface 201 of the recording head 101 with the maintaining unit 107 will be described. The broken lines in the drawings represent the phantom view of the interior of the cleaning liquid outlet 502. The process of wiping the ink ejecting surface 201 has: a standby step, a wiping step, a blade cleaning step, a cleaning liquid applying step, a swinging step, and a recovery step.

In the standby step, the blade 301 is kept on standby in the cleaning blade standby position 313 (6A). When the blade 301 is in its standby position, the recording head 101 is recording an image, is being subjected to the operation for suctioning out the ink in the ink ejecting nozzles 202, or remains capped. Also in this step, the cleaning end portion of the blade 301 remains coated with the cleaning liquid which was applied thereto in the preceding cleaning liquid applying step.

Figure 6A:
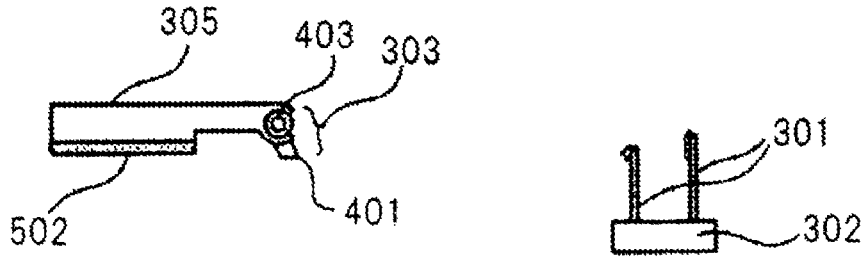
FIG. 6A is a drawing of the blade cleaning means, which is on standby.
Figure 6B:
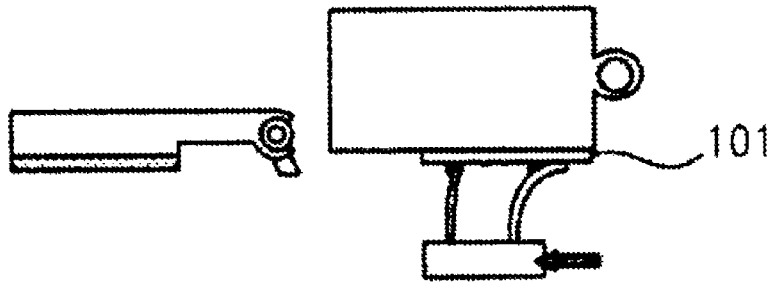
FIG. 6B is a drawing for describing the wiping step in the recording head maintaining process.

In the wiping step, the ink ejecting surface 201 of the recording head 101 is wiped by the blade 301 (FIG. 6B). More specifically, as a command for wiping the ink ejecting surface 201 is issued, the recording head 101 is moved to the ink ejecting surface cleaning position 312 in the maintenance unit 107 so that the ink ejecting surface 201 is positioned in the path of the blade 301. Then, the blade holder 302 is moved. As the blade holder 302 is moved, the cleaning edge of the blade 301 glides across the ink ejecting surface 201 while remaining in contact with the ink ejecting surface 201, wiping the ink ejecting surface 201. Thus, when the recording head 101 is wiped next time, it is wiped with the clean blade 301.

Further, the cleaning edge of the blade 301 is coated with the cleaning liquid. Therefore, the ink ejecting surface 201 is supplied with the cleaning liquid during the wiping step. Therefore, the contaminated ink on the ink ejecting surface 201 can be very effectively removed through the wiping step. As the wiping step is carried out, the mixture of the contaminated ink and cleaning liquid, which has been wiped away from the ink ejecting surface 201, adheres to the blade 301.

Figure 6C:
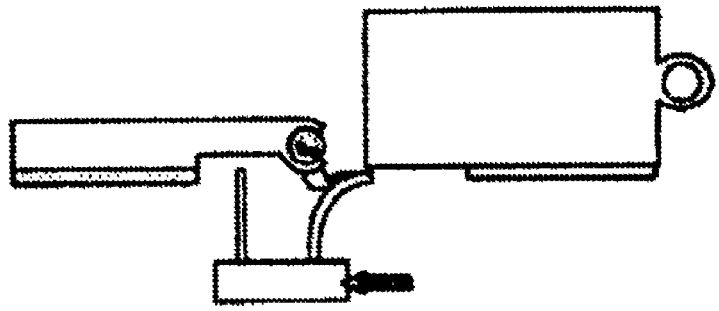
FIG. 6C is a drawing for described the blade cleaning step in the recording head maintaining process.

In the blade cleaning step, the contaminated ink having adhered to the blade 301 during the wiping step is recovered (FIG. 6C). More specifically, after the completion of the wiping step, the cleaning edge portion of the blade 301 is placed in contact with the edge portion 401 of the blade cleaning means 303, and is moved toward the cleaning liquid supplying means 305 while being rubbed by the edge portion 401. During this movement of the blade 301, the edge portion 401 remains stationary in its home position, because the ink guiding tubes 304 have come into contact with the waste ink absorbing member 310, being thereby prevented from rotating in the clockwise direction. Therefore, the contaminated ink having adhered to the blade 301 is scraped away by the edge portion 401 of the blade cleaning means 303. The body of ink having just been scraped away from the blade 301 is recovered from the edge portion 401 by the recovery portion 402, and is quickly guided into the ink guiding tubes 304 by the capillarity of the grooves of the recovery portion 402.

Figure 6D:
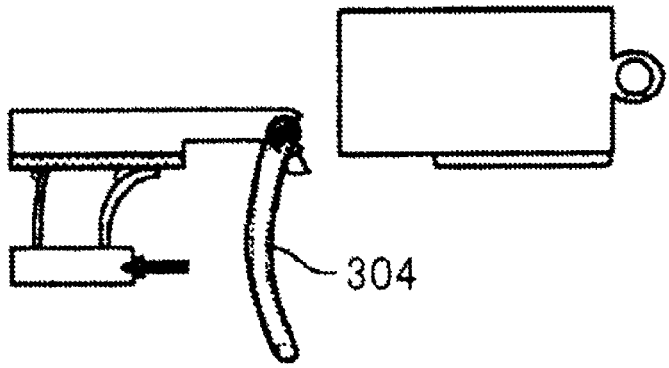
FIG. 6D is a drawing for describing the cleaning liquid applying step in the recording head maintaining process.

In the cleaning liquid applying step, the cleaning liquid is applied to the edge portion of the blade 301 (FIG. 6D). More specifically, after the completion of the blade cleaning step, the blade 301 is continuously moved toward the cleaning liquid supplying means 305, until the cleaning edge portion of the blade 301 comes into contact with the cleaning liquid outlet 502, by which the cleaning edge portion of the blade 301 is to be coated with the cleaning liquid. In other words, the cleaning liquid applying step is carried out simply by moving the blade 301 straight forward. This is possible because the blade cleaning means 303 is between the recording head cleaning position 312 of the maintenance unit 107, and the cleaning liquid supplying means 305.

After the coating of the blade 301 with the cleaning liquid, the blade 301 is moved backward to be returned to its standby position 313.

Figure 6E:
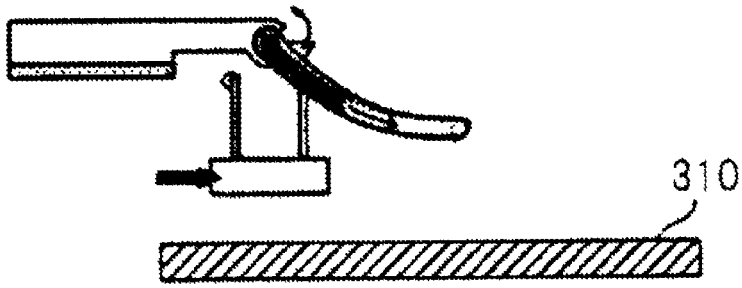
FIG. 6E is a drawing for describing the swinging step in the recording head maintaining process.

The swinging step is the step for making it easier to retract the blade 301 (FIG. 6E). More specifically, after the completion of the cleaning liquid applying step, the blade 301 is continuously moved backward, and is made to pass by the blade cleaning means 303 from the opposite direction from the direction in which it is made to pass by the blade cleaning means 303 in the blade cleaning step. During this backward movement of the blade 301 along the blade cleaning means 303, the blade 301 continuously pushes up the edge portion 401 of the blade cleaning means 303. The blade cleaning means 303 is structured so that it is allowed to rotate about the joint portions 403, in the counterclockwise direction in FIG. 6E. Thus, it does not occur that the blade 301 is subjected to a large amount of resistance from the blade cleaning means 303. Therefore, the blade 301 can be easily retracted. During this step, the ink guiding tube 304 is rotated about its lengthwise end on the contaminated ink entrance side by the rotational movement of the blade cleaning means 303.

After the contaminated ink is scraped away in the blade cleaning step, it is guided into the ink guiding tube 304 through the area with which the blade 301 does not come into contact. Therefore, it does not occur that the contaminated ink transfers back onto the blade 301 in the swinging step.

Figure 6F:
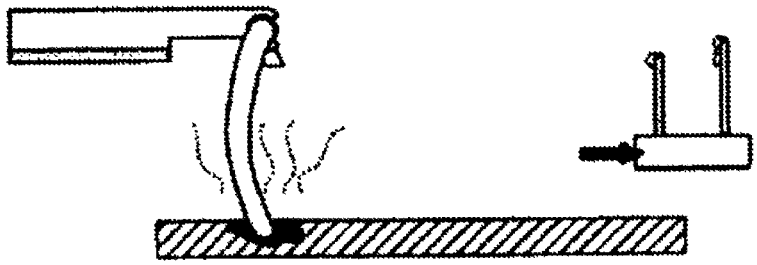
FIG. 6F is a drawing for describing the recovery step in the recording head maintaining process.

In the recovery step, the blade 301 retracts into its standby position 313 (FIG. 6F). More specifically, as the blade 301 separates from the edge portion 401 toward the end of the recovery step in which it is moved backward along the blade cleaning means 303, the blade cleaning means 303 and ink guiding tube 304 rotate, due to their own weight, in the opposite direction from the direction in which they were rotated in the swinging step. As a result, they regain the natural posture, in which they remain stationary, with the bottom end of each ink guiding tube 304 remaining in contact with the waste ink absorbing member 310. That is, in the swinging step and recovery step, each of the ink guiding tubes 304 swings about its lengthwise end, from which the contaminated ink entrances the ink guiding tube 304. This swinging of the ink guiding tube 304 subjects the contaminated ink in the ink guiding tube 304 to centrifugal force, which works in the direction to guide the ink out of the ink guiding tube 304, adding to the efficiency with which the contaminated ink is guided into the waste ink absorbing member 310.

As the retraction of the blade 301 continues, the blade 301 eventually returns to its standby position. Also in this step, the recording head 101 is set aside from the path of the blade 301, in order to prevent the blade 301 from coming into contact with the recording head 101. As the blade 301 returns to its standby position 313, the maintenance unit 107 becomes ready for cleaning, and remains on standby.

(Embodiment 1—Another Embodiment of Maintenance Unit)

Figure 7:
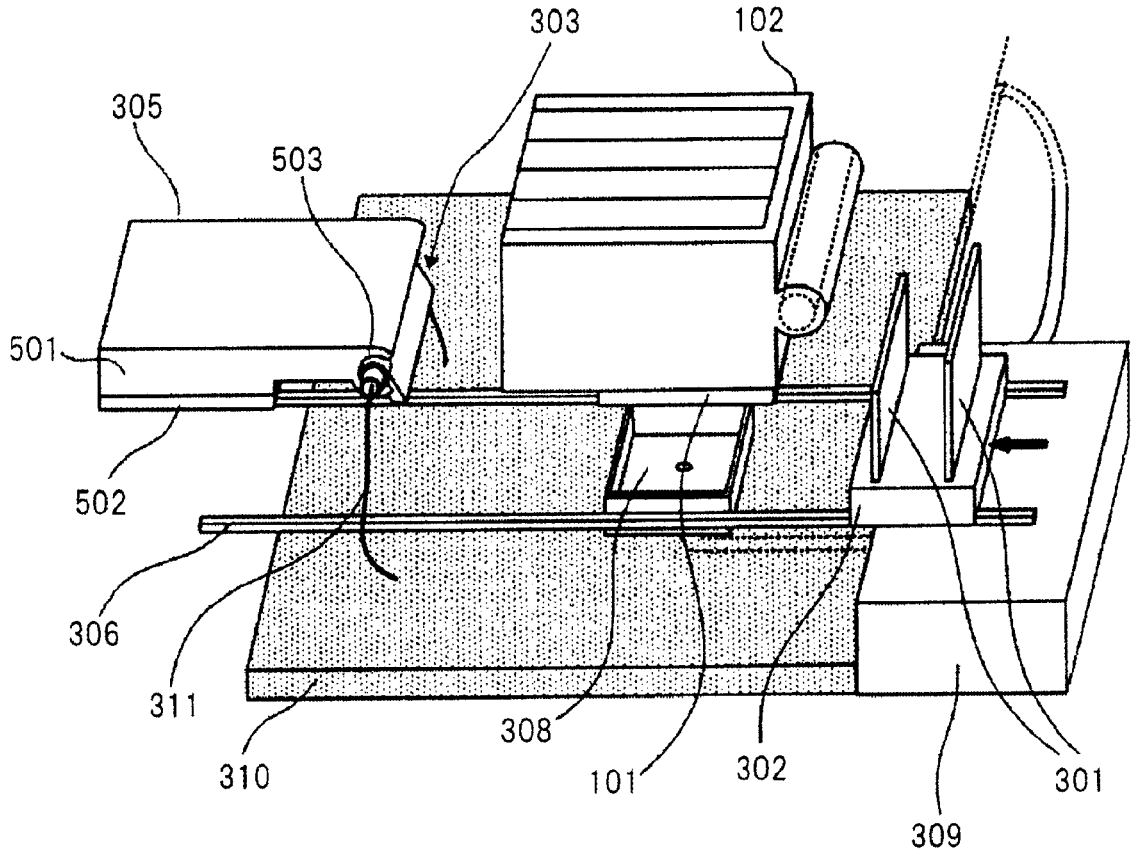
FIG. 7 is a perspective view of the maintenance unit in another preferred embodiment of the present invention.

Next, another embodiment of the maintenance unit will be described. FIG. 7 is a perspective view of the maintenance unit in another embodiment of the present invention, and shows the structure of the unit. The maintenance unit in this embodiment has a pair of blades 301, a blade cleaning means 303, a cleaning liquid supplying means 305, and a waste ink absorbing means 310. These components, except for one of them, are similar in structure to the counterparts of the maintenance unit 107 shown in FIG. 3. The one component which is different from the counterpart shown in FIG. 3 is the ink guiding member for providing the maintenance unit with the ink path for guiding the contaminated ink recovered by the blade cleaning means 303, into the waste ink absorbing member 310.

In this embodiment, the maintenance unit is provided with a pair of fibrous members 311 as the members for guiding the contaminated ink into the waste ink absorbing member 310. The fibrous members 311 are attached to a pair of joint portions 503, one for one, with which the blade cleaning means 303 is provided. The joint portion 503 is a piece of hollow tube. More specifically, the fibrous member 311 is connected to the recovery portion 402 of the blade cleaning means 303, with the interposition of the joint portion 503 between the recovery portion 402 and fibrous member 311, so that the liquid flows from the blade cleaning means 303 to the fibrous member 311 through the joint portion 503. Thus, the contaminated ink recovered by the recovery portion 402 of the blade cleaning means 303 is transmitted to the fibrous member 311 through the joint portion 503.

Like the above described ink guiding tube 304, the fibrous member 311 guides the contaminated ink, which it has received from the joint portion 503, into the waste ink absorbing member 310. The fibrous member 311 is desired to have a certain level of wettability so that it can efficiently guide the contaminated ink into the waste ink absorbing member 310.

Further, since the waste ink absorbing member 310 is directly below the blade cleaning means 303, the contaminated ink in the fibrous member 311 is effectively guided onto the waste ink absorbing member 310 by gravity.

The maintenance unit in this embodiment may be structured so that the fibrous member 311 is made to swing like the ink guiding tubes 304 in the first embodiment, in order to raise the level of efficiency with which the contaminated ink is guided out of the fibrous members 311.

In the above, a couple preferred embodiments of the present invention have been concretely described. However, these embodiments are not intended to limit the present invention in scope. That is, it is needless to say that the preferred embodiments are variously modifiable as long as the modifications do not contradict the gist of the present invention. For example, the structural components in the preceding embodiments of the present invention can be modified in shape, positioning, etc., as long as the modifications are compatible with the present invention.

In the preceding embodiments of the present invention, the maintenance unit 107 is provided with two blades 301. However, the blade count may be one, or three or more. That is, the blade count may be changed in accordance with the shape, performance, etc., of the recording head 101. Further, the shape of the blade 301 does not matter as long as the blade 301 can efficiently wipe the ink ejecting surface 201 of the recording head 101, and also, can efficiently remove the contaminated ink having adhered to the ink ejecting surface 201.

Further, regarding the shape of the recovery portion 402 of the blade cleaning means 303, the recovery portion 402 does not need to be shaped like a piece of hollow column, a part of which is missing. That is, the shape of the recovery portion 402 may be any as long as the recovery portion 402 can move the contaminated ink to the ink guiding tubes, or fibrous members, after the contaminated ink is scraped away from the blades 301 by the edge portion 401.

Further, in these embodiments, the blade cleaning means 303 is supported by the cleaning liquid supplying means 305. However, as long as the blade cleaning means 303 is positioned so that it can come into contact with the blades 301, it is not mandatory that the blade cleaning means 303 is supported by the cleaning liquid supplying means 305.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 315819/2007 filed Dec. 6, 2007, which is hereby incorporated by reference.

What is claimed is:

1. An ink jet recording apparatus comprising:

a recording head having an ink ejection surface;

a blade for wiping said ink ejection surface;

blade cleaning means for cleaning said blade by collecting contamination liquid deposited on said blade including at least ink;

a residual ink absorbing material provided at such a position so that it is not in contact with said blade;

and a discharge path for discharging the contamination ink collected by said blade cleaning means to said residual ink absorbing material, wherein said discharge path includes a tube-like member having a capillary force.

2. An apparatus according to claim 1, wherein said blade cleaning means includes an edge portion scraping the contamination ink off said blade, and a collecting portion for collecting the contamination ink removed by said edge portion, and wherein said collecting portion is connected with said discharge path.

3. An apparatus according to claim 2, wherein said collecting portion is provided with one or more grooves having a capillary force.

4. An apparatus according to claim 1, wherein the ink ejected from said recording head comprises at least a pigment.

5. An apparatus according to claim 1, further comprising means for swinging said discharge path about a contamination ink inlet end portion of said discharge path.

6. An apparatus according to claim 1, wherein said residual ink absorbing material includes a porous member, and a capillary force of said porous member is larger than the capillary force of said tube-like member.

7. An apparatus according to claim 1, wherein said residual ink absorbing material is disposed below said blade cleaning means.

8. An apparatus according to claim 1, wherein said residual ink absorbing material has a wetting property.

9. An apparatus according to claim 1, further comprising suction means for sucking the ink from said recording head, wherein a liquid containing portion contains the ink sucked out by said suction means.

10. An apparatus according to claim 1, further comprising cleaning liquid supply means for supplying, to said blade, cleaning liquid mainly comprising liquid having a volatility lower than the ink.

11. An apparatus according to claim 10, wherein said cleaning liquid comprises not less than 50% of glyceline.

12. An apparatus according to claim 10, wherein the contamination ink deposited on said blade is a mixed liquid of the ink and the cleaning liquid.

13. An apparatus according to claim 10, wherein said blade is reciprocable, and said blade cleaning means is disposed across a movement path of said blade and between a cleaning position for said recording head and said cleaning liquid supplying means.

* * * * *